United States Patent [19]

Mason

[11] Patent Number: 4,817,902

[45] Date of Patent: Apr. 4, 1989

[54] CORNER PROTECTOR AND COVER

[76] Inventor: Donald R. Mason, 104 Magnolia Ave., Magnolia, Mass. 01930

[21] Appl. No.: 42,000

[22] Filed: Apr. 24, 1987

[51] Int. Cl.[4] ..... A47B 95/00

[52] U.S. Cl. ..... 248/345.1; 108/27; 52/288; 248/1 R

[58] Field of Search ..... 248/102, 345.1, 9.5; 52/288, DIG. 13; 49/460, 462; 108/27

[56] References Cited

U.S. PATENT DOCUMENTS

| | | | |
|---|---|---|---|
| 2,191,956 | 2/1940 | Coldren | 297/224 |
| 2,409,820 | 10/1946 | Zimmern | 248/102 |
| 2,995,863 | 8/1961 | Bright | 248/345.1 |
| 3,030,728 | 4/1962 | Wesman | 248/345.1 |
| 3,041,775 | 7/1962 | Brown, Jr. et al. | 248/345.1 |
| 3,093,924 | 6/1963 | Pompa | 248/345.1 |
| 3,144,236 | 8/1964 | Clanin | 248/345.1 |
| 3,150,854 | 9/1964 | Jamieson | 248/345.1 |
| 3,725,188 | 4/1973 | Kalt | 248/345.1 X |
| 3,762,626 | 10/1973 | Dorsey | 248/345.1 X |
| 3,960,354 | 6/1976 | Simikoski | 108/27 X |
| 4,072,231 | 2/1978 | Helms | 248/345.1 X |
| 4,117,782 | 10/1978 | Cahill | 108/27 |
| 4,192,423 | 3/1980 | Rekow | 248/345.1 X |
| 4,201,359 | 5/1980 | Baslow | 248/915 X |
| 4,240,225 | 12/1980 | Sartaini | 248/345.1 X |

*Primary Examiner*—Ramon S. Britts
*Assistant Examiner*—David L. Talbott
*Attorney, Agent, or Firm*—Donald N. Halgren

[57] ABSTRACT

A corner protector assembly for the cushioned covering of corners of tables of the like, so as to prevent harmful collisions between young children and the furniture on which the protector assembly is attached. The protector assembly comprises a resilient inner core which is "corner shaped" and matable to a corner of furniture. An outer cover, having an elasticized hem, is adapted to fit like a mitt over the inner core. The outer cover also has a pair of tie strings which secure the cover over the inner core and secure both to the leg at the corner of the table. The cover is readily removable from the inner core and the assembly is easily removable and reattachable.

13 Claims, 2 Drawing Sheets

CORNER PROTECTOR AND COVER

BACKGROUND OF THE INVENTION

This invention relates generally to corner guards, and more particularly to protective devices for corners of furniture.

PRIOR ART

This invention protects children from hurting themselves on corners of tables and furniture. Tables and counters which usually provide no danger to older children and adults may be very dangerous to young children. The corners of coffee tables in the living room can be hazardous to teeth and eyes of babies and toddlers.

Several patents are directed towards cushioning corners of furniture, such as that to Wesman, U.S. Pat. No. 3,030,728. This is attached to furniture by suction means. Unfortunately suction does not always last very long particularly on waxed surfaces. The corner device is not attractive and after a while, rubber or elastic material comprising this device, may become hard and less capable of staying on the corner. Another corner guard is shown in U.S. Pat. No. 3,041,775 to Brown, Jr. et al. It is a rather obtrusive device which is held to a furniture corner by adhesive tape. There is no provision for readily moving or changing the style of this device, as recited in the present invention.

A further guard device is shown in U.S. Pat. No. 3,150,854 to Jamieson. It is made from a molded plastic material and attached to the furniture by adhesive. Again, nothing facilitates changing the guard from one place to another place, or to change its appearance.

Additional U.S. Patents of interest are U.S. Pat. Nos. 3,093,924 to Pompa; 3,725,188 to Kalt; 4,072,231 to Helms; 3,762,626 to Dorsey and 4,240,225 to Sartain.

One conspicuous shortcoming of all the prior art is its inability to be easily changed in style or location. Additionally, the prior art utilizes adhesive or suction means of some sort to attach the guard to the corner of the furniture. This attachment may be of a permanent nature, or it may damage the finish of the furniture if the guard were to be removed.

It might be desirable to take furniture guards from home with you as a portable protective device, if parents of a young child were to travel or visit places where the child were to play, and these places had low tables or corners against which a child could be hurt.

It may be further desirable to change the style or to make a decorative alteration to these corner guards or protectors from time to time. None of the prior art permits the corner guards to be readily moved and easily changed from a decorative point of view.

It is an object of the present invention to provide a corner guard or bumper which is readily attachable to the corner of a structure such as a piece of furniture.

It is a further object of the present invention to provide a corner guard or bumper which is attachable to furniture by means that will not damage the furniture upon removal of the corner guard or bumper.

It is yet a further object of the present invention to provide a corner guard or bumper whose appearance or decorative features may be readily changed to meet changing styles or decors.

It is still a further object of the present invention to provide a corner guard or bumper which can be easily cleaned.

SUMMARY OF THE INVENTION

The present invention involves a corner guard/protector or bumper comprising a soft resilient inner core which is shaped to fit onto a corner. The invention also comprises an outer mitt or cover which fits over the outside of the inner core. The outer mitt or cover has an elasticized hem which is utilized to hold the mitt onto the inner core. The mitt also may have an arrangement of ties for securing the entire guard or bumper to a furniture corner.

The inner core may be made from any foam or injection molded plastic or rubber compound. The inner core may also be made as an inflatable bladder which is matable with a furniture corner.

The inner core may be already pre-configured in a solid pre-formed shape or bulbous shape to mate with a corner and it may also have decorative embossments thereon. It may also be constructed in a planar configuration, and folded along pre-arranged creases so as to adapt to a corner.

The outer mitt or cover has an elasticized hem so as to cause the cover to gather at the edges and hold the cover snugly around the inner core. The ties extend from opposite sides or ends of the cover and are about 12" to about 16" long, sufficient to be able to be tied around and behind a leg of the furniture/table to which it may be attached. Several small securement means such as screw eyes or the like may be arranged on the bottom edge of the furniture/table to permit the ties to be secured thereto. The ties may have gripping means at their distal ends, such as that marketed under the trademark 'Velcro', to secure themselves to one another.

The cover may have an inflatable or padded structure therein, to provide additional cushioned safety and resilience to the guard/bumper. The cover may be made of any suitable material such as cloth in a quilted or doubled layer or woven fibers, or plastic sheet. The cover may have decorative patterns or colors thereon, as well as have animal or cartoon-like features imprinted or attached thereto and it may be reversible from one side to another. The decorative features of the corner guard or bumper make the corner more noticeable by and hence less likely to be inadvertently struck by small children. They would therefore be less likely to run into or hit the corner with the guard or bumper attached to it.

By attaching the corner bumper protector by tying means, it is readily removable from one table and attachable to another, as for instance, when one goes visiting another's home with small children, and the visitor wishes to make the home more "child safe".

The cushioned mitt or cover may be taken off for cleaning or for changing styles in the home in which it is being used, and it may be reversed to change colors or decorations from one side to the other.

BRIEF DESCRIPTION OF THE DRAWINGS

The objects and advantages of the present invention will become more apparent when viewed in conjunction with the following drawings, in which.

DESCRIPTION OF THE PREFERRED EMBODIMENTS

Figure 1:
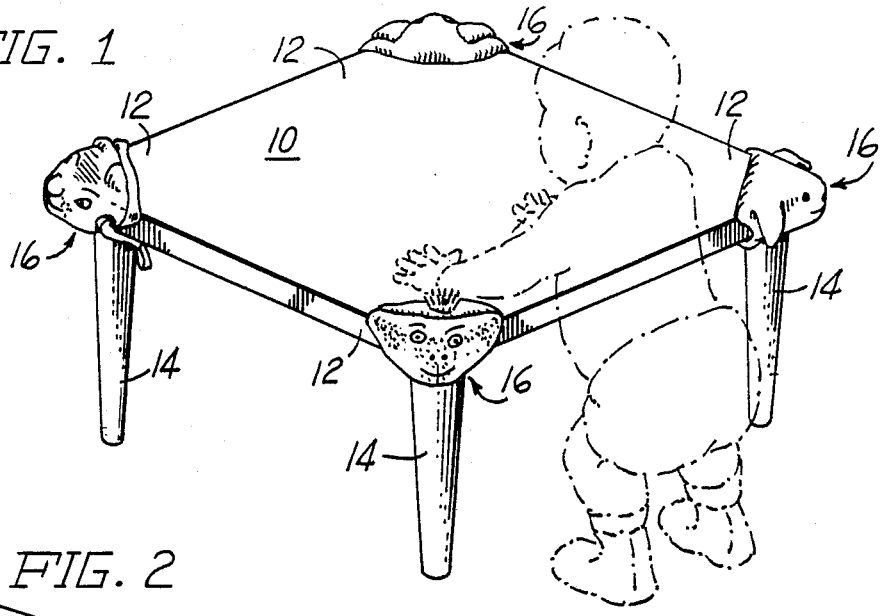
FIG. 1 is a perspective view of an article of furniture having an arrangement of corner protectors thereon.

Referring now to the drawings in detail, and particularly to FIG. 1, there is shown a piece of furniture 10, such as a coffee table found in a typical home. The furniture 10, in this example, the table, has a plurality of corners 12. A leg 14 is generally disposed beneath each corner 12. A corner protector assembly 16 is shown arranged on each corner 12. The corner protector assembly 16 could be called a "Baby Bumper". It is useful to eliminate the dangers associated with the pointed corners of furniture, and small children who strike them inadvertently.

Figure 4:
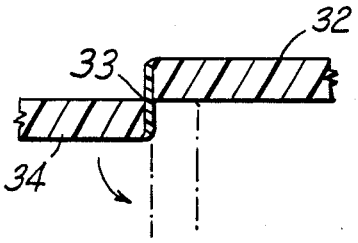
FIG. 4 is a view taken along the liner IV—IV of FIG. 3.
Figure 5:
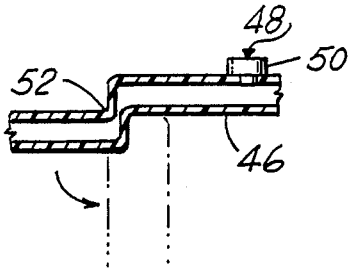
FIG. 5 is a view similar to FIG. 4, in a different embodiment thereof.
Figure 6:
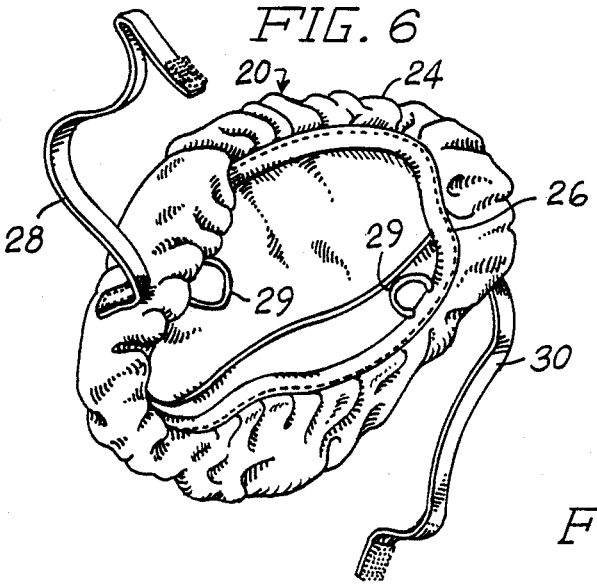
FIG. 6 is a side view of a cover of the present invention.
Figure 7:
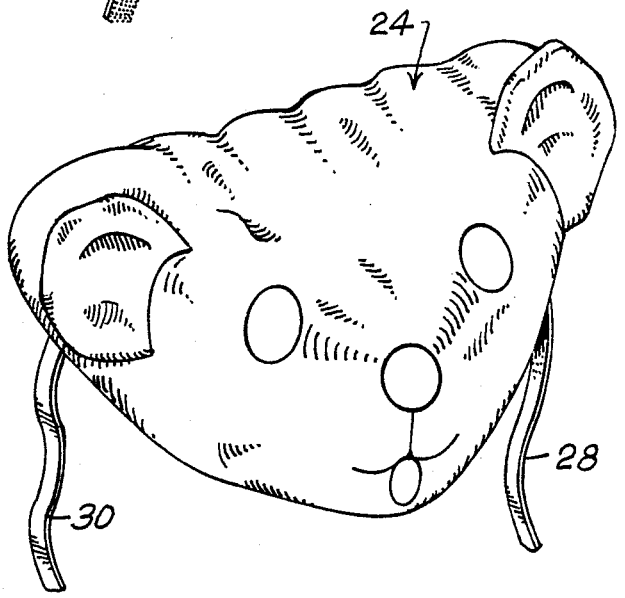
FIG. 7 is an alternative embodiment of the cover of the present invention.

The corner protector assembly 16 generally comprises an inner core 18, shown more particularly in FIGS. 2-5, and an outer cover 20, or mitt, shown in FIGS. 6 and 7.

Figure 2:
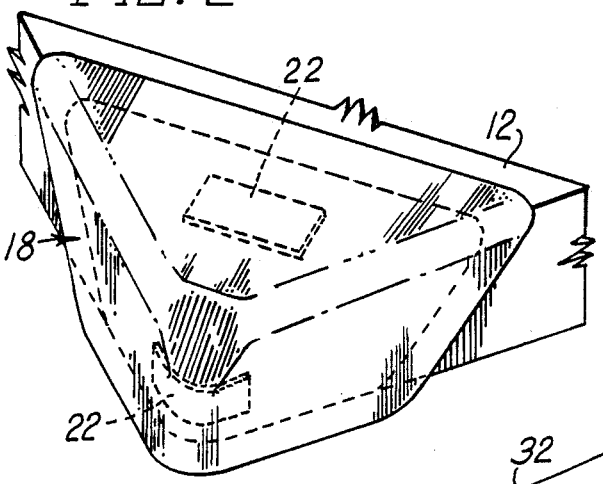
FIG. 2 is a perspective view of an inner core arranged on a corner of an article of furniture.

The inner core 18, in the preferred embodiment, is made from a "corner" shaped arrangement of resilient material such as styrofoam, foam rubber or any similar soft material which can be adapted to mate onto the peripheral apex of a piece of furniture, such as the corner of a table or a counter. The inner core 18, as shown in FIG. 2, may be held in place by gripping means 22 such as adhesive tape or gripping surfaces marketed under the trademark 'Velcro', arranged on the inside surface of the inner core 18, between the inner core 18 and the corner to which it is mated. The inner core 18, as shown in FIG. 2 is a pre-formed shape having an upper surface and two edge surfaces, all of resilient material, having a "corner" configuration. The inner core 10 could also include a lower horizontal surface, not shown, which covers the bottom side of a corner.

The outer cover 20, shown generally, in FIG. 6, is comprised of a cloth or flexible material to form a mitt 24. The mitt 24 is configured so as to conform to the outer shape of the inner core 18. An elastic border 26 or hem is attached, preferrably by stitching, to the periphery of the mitt 24.

A pair of draw strings 28 and 30 or ties are attached to the mitt 24, so as to provide securement means for the outer cover 20 against the inner core 18 and the inner core 18 against a table, such as represented by the furniture 10 shown in FIG. 1. A pair of loops 29, may be attached to the elastic border 26, to which the draw strings 28 and 30 may be secured.

The inner core 18 is placed onto a corner of a piece of furniture, the outer cover 20 being placed thereover. The elastic border 26, comprising the hem therearound, draws the mitt 24 snugly onto the inner core 18.

The draw strings 28 and 30 may be brought around the leg of the furniture and tied or held together by gripping means such as the aforementioned 'Velcro', to hold the corner protector assembly 16 onto that corner. The draw strings 28 and 30 permit the corner protector assembly 16 to be easily attached and unattached from any given corner of furniture. This is very useful when parents of a young child go visiting at someone else's non-babyproofed home.

Figure 3:
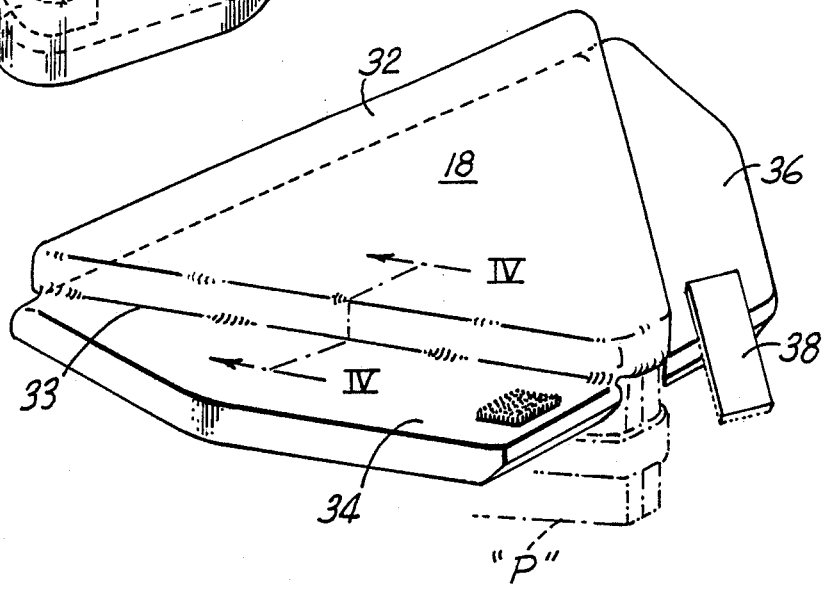
FIG. 3 is a plan view of a planar embodiment of the inner core.

A further embodiment of the inner core 18, is shown in FIG. 3, wherein a generally triangularly shaped piece of soft-resilient material 32 is arranged to be folded on a pair of crease lines 33. The crease lines 33 permit the inner core 18 to be purchased or transported in a generally flat orientation. By having an arrangement of crease lines 33, the material 32, has sides 34 and 36 which can be folded down, over the edges of a table, as shown in FIG. 2 and shown by the phantom lines "P" in FIG. 3. One of the sides 36 may have a tab 38 thereacross. The tab 38 may comprise gripping means such as a tape of 'Velcro' type material or the like thereon so as to secure itself to the underside of the side 34, thus over the folded inner core 18, as described in the earlier embodiment.

FIG. 4 shows a cross-sectional view of the soft-resilient material 32, which comprises the inner core 18 The crease line 33 is shown, consisting of a linear depression arranged onto one or both sides of the material 32 or it may comprise a flexible piece of material such as plastic, or rubber like material flexibly joining portions of the inner core 18. The material comprising the inner core 18, in FIG. 4 may be selected from thee group such as foam rubber, styrofoam, or any suitable soft molded plastic.

A further embodiment of the inner core 18, is shown in FIG. 5, which represents an inflatable bladder 46, whose overall configuration is the same as the inner core 18 shown in FIG. 3, but which has inflation means 48, such as a valve 50. The bladder 46 would have "side" portions, and a web 52 connecting the body portions to one another. The "side" portions of the bladder 46 would fold over the edges of a table or the like, along the webs 52 thereof.

The outer cover 20 may itself be of padded, multi-layered, or quilted material, to increase the softness of the corner of any furniture to which it is attached. The cover 20, in its padded configuration may be constructed with cushioning material sandwiched between layers of material, or may have a further inflatable bladder thereacross, to provide the addition cushioning to the inner core 18.

The outer surface of the mitt 24 may be of any color to go with any decor of a particular home, or, as shown in FIG. 7, it may have animal, human or cartoon-type characters sewn, drawn or superimposed thereon. The mitt 24 may be decorated on its inner surface so that it may be termed inside out for a different pattern or decoration showing. The decorating of the mitt 24 in this fashion calls attention to its presence to young children and infants, who are more likely to notice it, and thus avoid colliding with it, to their detriment.

Thus there has been shown a unique combination of an inner core and an outer cover to provide protection to corners of furniture. The outer cover is easily attachable and disattachable to furniture for cleaning, changing patterns to fit decorative styles or childrens favorite characters. The combination provides a simple and portable solution to the problem parents face when they take their young children on visits outside their own homes, to houses of others with furniture which might be dangerous to them.

We claim:

1. A two part corner protector assembly for the padded covering of a corner of structure, comprising:

a resilient inner core;

a separate flexible outer cover disposable about said inner core;

said outer cover including an arrangement of securement means including a stretchable hem removably securing said outer cover to said inner core, said tie members securing said assembly together and to the corner of a structure.

2. A corner protector assembly as recited in claim 1, wherein said inner core is comprised of pre-formed soft material having a "corner shape" so as to snugly mate with a corner of a structure with which it is to mate.

3. A corner protector assembly as recited in claim 2, wherein said outer cover has a cushioning material disposed therewithin.

4. A corner protector assembly as recited in claim 1, wherein said flexible outer cover has a decorative means thereon so as to facilitate observation thereof.

5. A corner protector assembly as recited in claim 4, wherein said outer cover has a decoration means on its inner surface and its outer surface.

6. A cover protector assembly as recited in claim 4, wherein said decorative means comprises facial character.

7. A corner protector assembly as recited in claim 1, wherein said inner core is foldable from a plurality of flat pieces of resilient material into a "corner shape" to facilitate its mating therewith.

8. A corner protector assembly as recited in claim 4, wherein said inner core has an arrangement of crease lines between said pieces, which permits said inner core to be folded therealong.

9. A corner protector assembly as recited in claim 8, wherein a flexible piece of material joins said pieces of resilient material to permit them to articulate therefore together.

10. A cover protector assembly as recited in claim 4, wherein said inner core has side portions and a tab portion thereon, with a fastening means on said tab so as to anchor on side of said inner core with respect to the other side of said inner core.

11. A corner protector assembly as recited in claim 7, wherein said inner core is comprised of an inflatable bladder.

12. A corner protector assembly as recited in claim 1 wherein said tie members are arranged to be tyable with one another around a portion of any structure to which it is to be mated.

13. A two part fender arrangement for attachment to the corner of a table, to protect the corner edges thereof, comprising:

an inner member comprised of soft resilient material;

an outer member having a layer of cushioning material, arranged to cover said inner member;

an arrangement of tie strings and an elastic hem as part of said outer member comprising securement means to attach said outer member to said inner member and the corner of a table structure to which it is to mate.

* * * * *